US005201108A

United States Patent [19]

Clark et al.

[11] Patent Number: 5,201,108

[45] Date of Patent: Apr. 13, 1993

[54] METHOD OF ASSEMBLING OFFICE FURNITURE WIRE ROD STACKING CHAIR

[75] Inventors: Craig A. Clark, Montgomery, Ill.; Robert J. Poortvliet, Jenison, Mich.

[73] Assignee: Allsteel Inc., Aurora, Ill.

[21] Appl. No.: 788,218

[22] Filed: Nov. 5, 1991

Related U.S. Application Data

[62] Division of Ser. No. 676,326, Mar. 28, 1991, Pat. No. 5,110,186, which is a division of Ser. No. 528,317, May 23, 1990, Pat. No. 5,064,247.

[51] Int. Cl.[5] ..... B23P 11/00

[52] U.S. Cl. ..... 29/434; 29/453; 29/525; 29/525.1

[58] Field of Search ..... 29/434, 463, 525, 525.1, 29/453

[56] References Cited

U.S. PATENT DOCUMENTS

| | | | |
|---|---|---|---|
| Re. 26,071 | 8/1966 | Rowland | 297/239 |
| 3,275,371 | 9/1966 | Rowland | 297/239 |
| 3,278,227 | 10/1966 | Rowland | 297/239 |
| 3,404,916 | 10/1968 | Rowland | 297/239 |
| 3,825,302 | 7/1974 | Kurtz | 297/452 |
| 3,826,453 | 7/1974 | Hitchcock | 297/248 |
| 4,365,840 | 12/1982 | Kehl et al. | 297/443 |
| 4,746,168 | 5/1988 | Bracesco | 297/443 |
| 5,035,494 | 7/1991 | Foldenauer | 29/525 |

FOREIGN PATENT DOCUMENTS 2060367 5/1981 United Kingdom .

*Primary Examiner*—P. W. Echols
*Assistant Examiner*—David P. Bryant
*Attorney, Agent, or Firm*—Lee, Mann, Smith, McWilliams, Sweeney & Ohlson

[57] ABSTRACT

A wire rod type stacking office furniture chair and method of assembling same, comprising, including a separate chair seat and back for same, a pair of endless rodding members each defining along the left and right sides of a chair a lower quadrilaterally contoured base frame having lower floor engaging runners that may be glide equipped and upper runners above the chair lower runners that support the chair seat between them, with the rodding members adjacent the rear of the chair each defining a similar vertically oriented upright, chair shoulder forming loop, between which shoulders the chair back is supported. The chair back comprises an assembly including a mounting pan fixed between the chair right and left side shoulder forming loops, an inner opaque back member, and an outer opaque back member, with such back members being secured together in opposed relation on either side of the mounting pan and in encapsulating relation to such pan, by interfitting devices that are also concealed. The chair seat also comprises a seat assembly including an opaque mounting seat pan and a bracket plate fixed to each of the rodding member upper runners; the seat pan and bracket plates are arranged to provide interfitting devices similar to those employed in connection with the seat back, for anchoring these chair components to the chair frame.

2 Claims, 5 Drawing Sheets 64
76
74
62
65
66
50
80
82
46
54A
90
86
90
78
55
116
44
92
84
92
68
120
44A
72
118
70
59
90
88
54
42
47
92
61
45A
54B
45
43
50
80
82
54
50
54
82
80
64
59
65
54
62
84
55
46
50
86
92
116
90
44
76
74
92
120
92
118
47
88
90
90
61
78
124
72
45
122
52
102
100
98
82
110
112
104
114
8
94
108
106

130
136
133
28
137
138
80
82
60
135
132
129
64
65
90
70
144
92
40
31
146
142
41
154
29
42
32
38
34
36
30
22
35
24
33
37
43
26
55
100
54
59
50
52
62
60
57
94
96
61
72
70
108
124
106
152
150
134
6B

METHOD OF ASSEMBLING OFFICE FURNITURE WIRE ROD STACKING CHAIR

This application is a division of our application Ser. No. 676,326, filed Mar. 28, 1991, now U.S. Pat. No. 5,110,186, which is a division of our parent application Ser. No. 528,317, filed May 23, 1990, now U.S. Pat. No. 5,064,247.

The present invention relates to office furniture chairs, and more particularly, to office furniture chairs of the wire rod type that are in the nature of side chairs, that have back and seat assemblies that can be readily assembled with or without fabrication, that can be stacked, and that can be ganged together in equally spaced relation horizontally, if so desired.

The assembly of the backs and seats of this type of chair heretofore has required fastening devices and tools for operating same which have made unduly complicated assembly of this type of chair, and also have made it difficult and time consuming to upholster the chair. Furthermore, chairs of this type, while desirably being equipped with glides on the underside of the chair, employ glides that may be suitable for carpeted floors, but are not suitable for uncarpeted floors (usually concrete floors), and vice versa. It has been also found desirable to not only have such chairs stackable for storage, but also gangable in side-by-side relation.

A principal object of the present invention is to provide a wire rod office furniture chair arrangement in which the basic chair support is composed of a pair of endless rodding members defining a lower quadrilaterally contoured base frame at the right and left side of the chair, which base frames define lower floor engaging runners and upper runners above the lower runners that support the chair seat between them, with such endless rodding members adjacent the rear of the chair each defining on the right and left sides of the chair a similar vertically oriented chair shoulder forming, upright loop, that supports the chair back therebetween.

A further principal object of the invention is to provide in chairs of this type, a unique back assembly for the chair comprising a mounting pan that is fixedly carried by the chair frame, an inner opaque back member and an outer opaque back member of similar sizing and being oppositely disposed on either side of the mounting pan in encapulating relation thereto, with the back inner and outer members and mounting pan therefor being formed to define interfitting devices that permit assembly of the chair back components in secure but adjustable relation, by relative movement alone between the respective back members and the mounting pan, with these components being arranged to optionally accommodate fabric coverings for the back members in an arrangement that facilitates the upholstery of these members that is automatically adjustable as to the thickness of the fabric employed, and that internally receives and masks the trimmed edges of the fabric coverings involved, so that no trim lines are visible.

Yet another important object of the invention is to provide a unique chair seat assembly in which the seat is in the form of a seat pan formed from a suitable opaque plastic material, and bracket plates between which the seat pan is affixed by interfitting devices similar to those employed in connection with the seat back assembly, with the seat assembly also optionally accommodating a fabric covering and having fabric edging masking characteristics that facilitate fabric covering of the chair seat and hides trim lines.

Yet another important object of the invention is to provide, in connection with wire rod office furniture of the type indicated, back and seat assemblies therefor that are assembled to the chair without tools as such, and that optionally also accommodate fabric coverings that may be applied to the exposed portions of the chair back and seat in such a manner that the trim lines involved are fully masked.

Still a further object of the invention is to provide a glide arrangement for wire rod type office furniture chairs involving front and rear glides at the chair right and left sides that are snap fit secured in place, and that have alternate embodiments that define lug and socket interconnecting means for releasably ganging adjacent of such chairs together in equally spaced side-by-side relation.

In accordance with the present invention, an armless office furniture chair, in the nature of a side chair, is provided, including a pair of spaced apart endless rodding members on the right and left hand sides of the chair that each define a lower quadrilaterally contoured base frame having a lower engaging runner and an upper runner above the lower runner on the respective sides of the chair between which the chair seat is secured.

The endless rodding members on either side of the chair adjacent the rear of the chair each define a similar vertically oriented, chair shoulder forming, upright loop, with the chair back being supported by and between the respective chair shoulders at each side of the chair.

The chair back itself is in the form of an assembly that includes a mounting pan that is fixed between the respective chair shoulders, with the back assembly further including rear and front back members that are formed from a suitable opaque plastic material and that are better termed inner and outer backs, respectively, which are formed to be secured together on either side of the seat pan by a connection arrangement that is entirely fastenerless in character; the inner and outer backs are configured to not only be applied to either side of the mounting pan in encapsulating relation to same, but also define an attractive back for the chair, and mask the trim lines of upholstering that may be applied to the chair back exposed surfacings at the option of the chair assembler.

The chair seat further comprises a separate seat assembly that includes an appropriately shaped mounting seat pan formed from a suitable opaque plastic material and a pair of bracket plates that are respectively secured, on either side of the chair, to the respective upper runners of the chair endless rodding members. Again, the securement of the seat pan to the chair bracket members is by way of a securement arrangement of the fastenerless type that leaves the seat pan securely locked in place with regard to the chair bracket plates.

The pair of endless rodding members that in effect form the foundation of the chair are secured together at the front of the chair by a single reinforcing member, and at the upper runners by a pair of reinforcing members between which the chair seat assembly is disposed.

The chair seat pan may or may not be upholstered, at the option of the chair purchaser, and if the seat pan is to be unholstered, before the seat pan is secured to the chairs, the fabric material therefor is applied across the top surface of the seat, with the fabric trim lines being disposed at the underside of the seat pan, whereby when the seat pan as upholstered is applied to the chair, the seat pan itself masks the fabric trim lines.

Further in accordance with the invention, the lower runners of the respective chair endless rodding members are equipped at the front and rear of the chair with glides that separate the chair runners, and thus the chair "legs" from the chair supporting surface, whether it be concrete, wood, or carpeting overlying an office floor. Such glides may be provided with a metal cover should the floor on which the chair is to rest is bare concrete, and may be in the form of ganging glides that are interlocked in a "jigsaw puzzle" configuration to connect separate chairs together, as in a horizontal row of the chairs, at the same level, and equally spaced apart; such ganging guides are readily disconnected for convenient chair stacking and storage, and are also formed to receive metal covers where the ganging glide is to be applied to chairs that rest on a bare of concrete floor.

Other objects, uses, and advantages will be obvious or become apparent from a consideration of the following detailed description and the application drawings, in which like reference numerals indicate like/parts throughout the several views.

Figure 2:
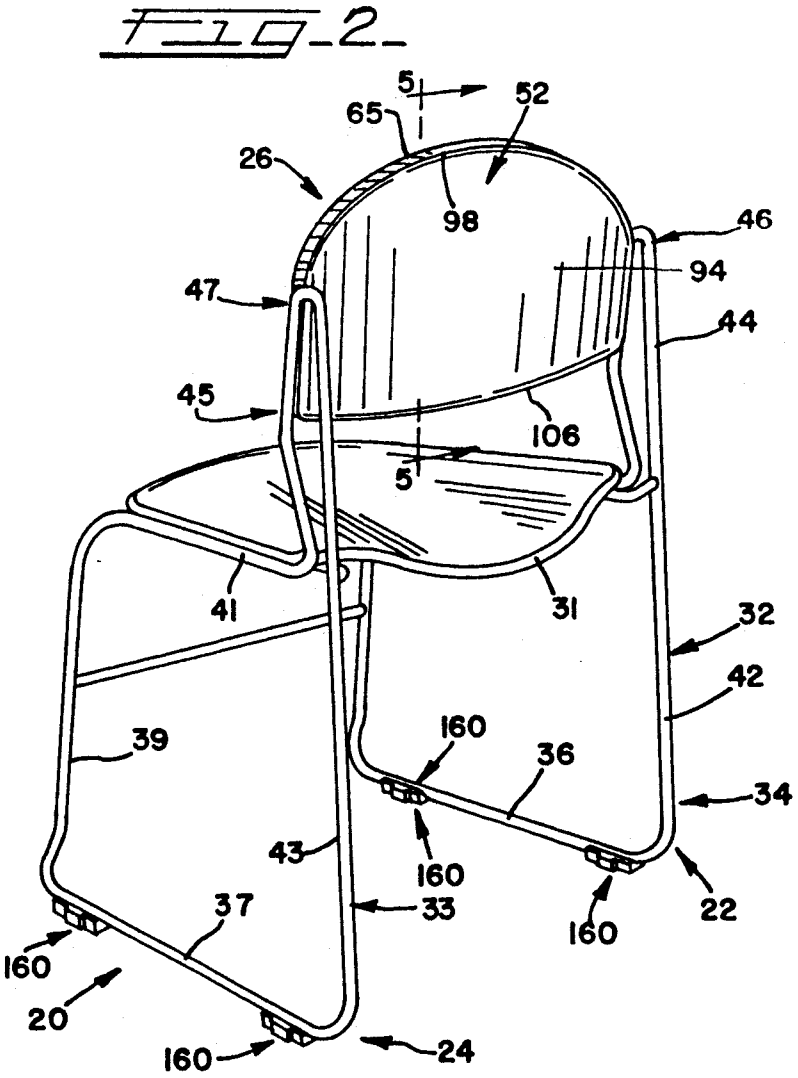
FIG. 2 is a left rear perspective view of the chair shown in FIG. 1.
Figure 1:
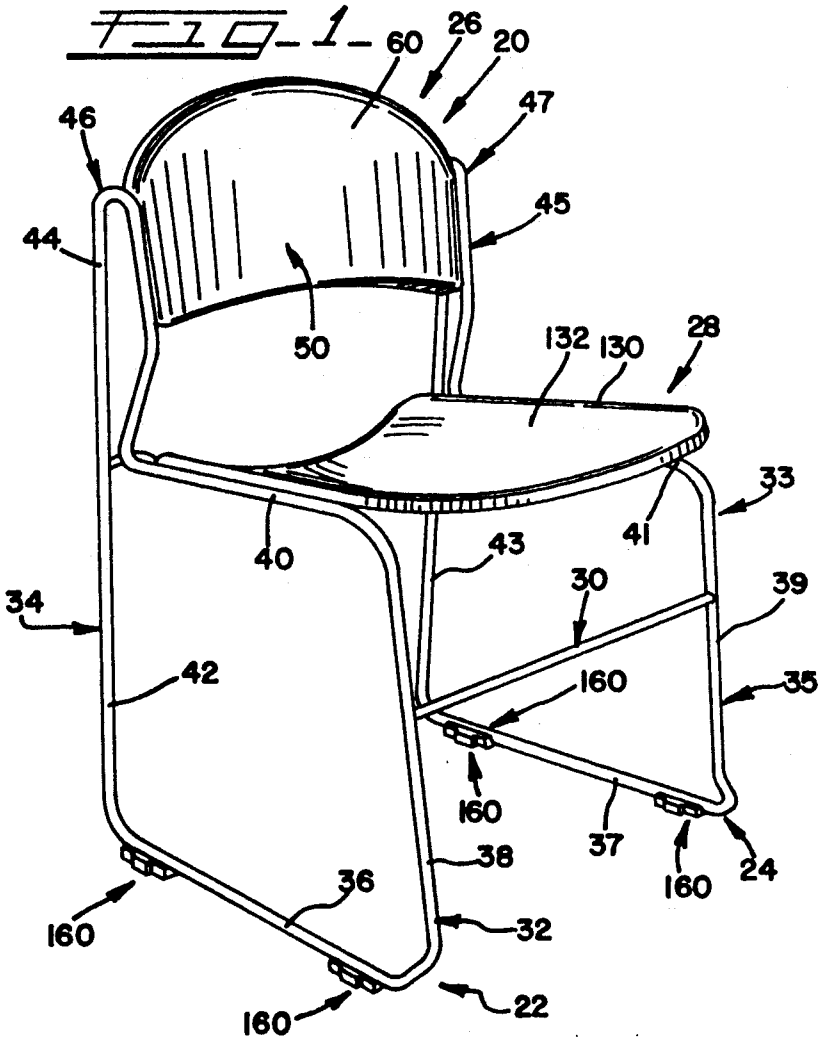
FIG. 1 is a right frontal perspective view of an office furniture armless stacking chair, arranged in accordance with the present invention, and shown fully assembled, and without upholstery on either the chair back or the chair seat.
Figures 3, 3A, 3B, 4:
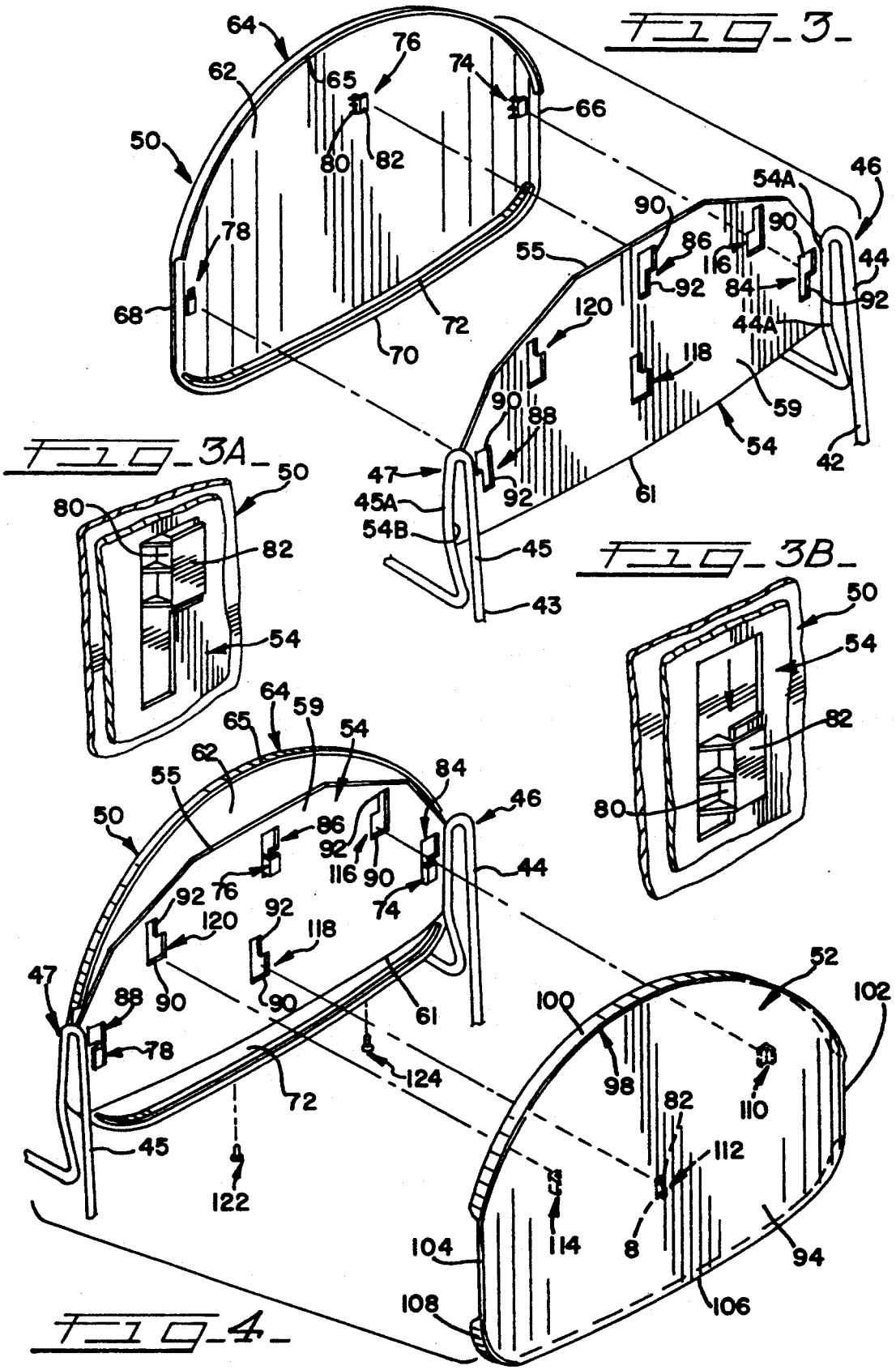
Figures 5, 6, 6A, 6B:
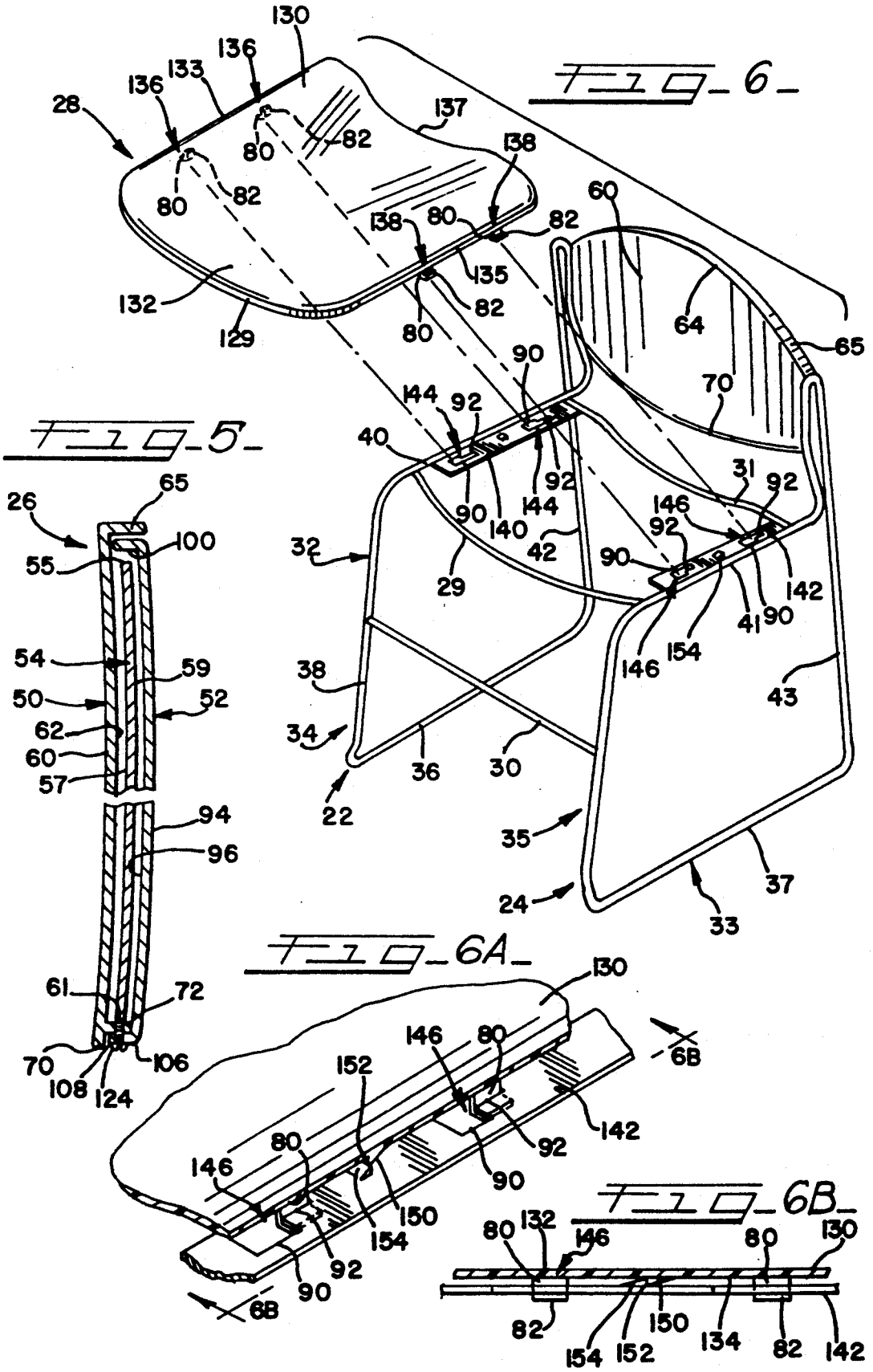
Figure 7A:
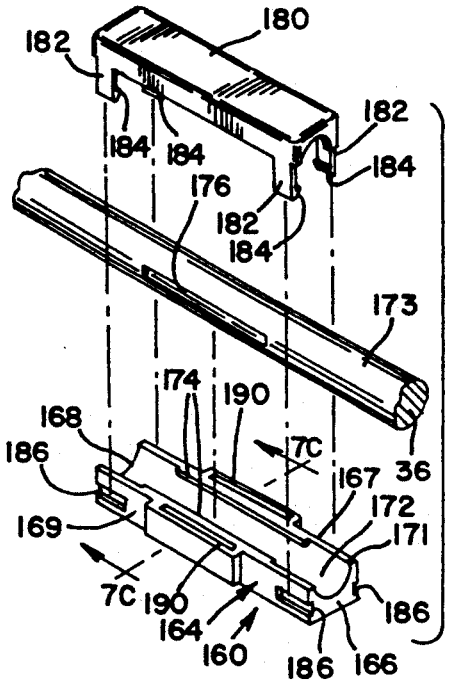
Figure 7B:
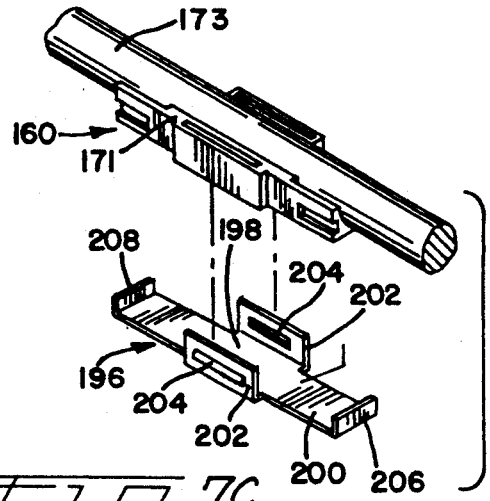
Figure 7C:
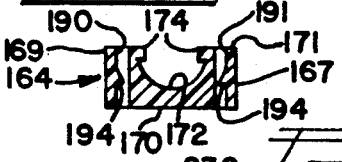
Figure 8A:
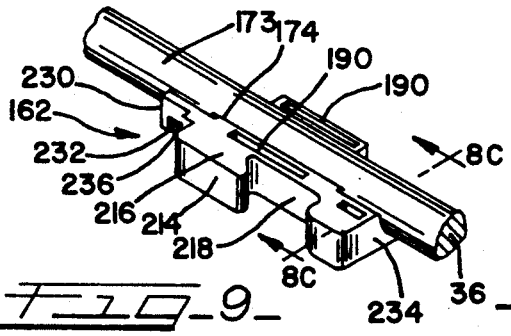
Figure 8B:
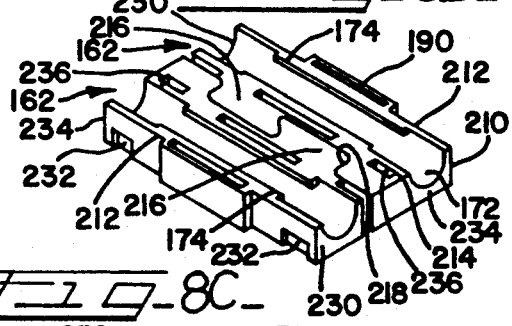
Figure 8C:
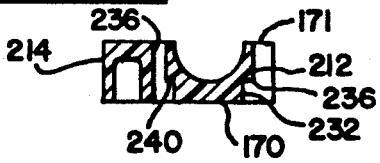
Figure 9:
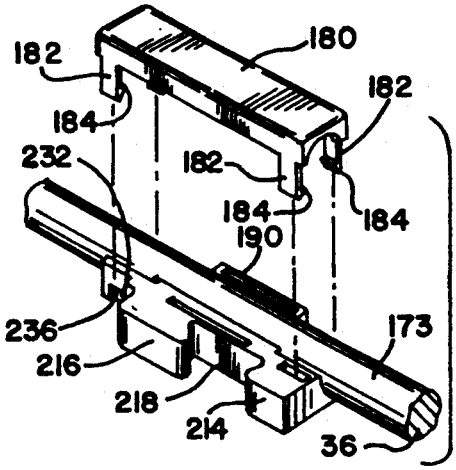
Figure 10:
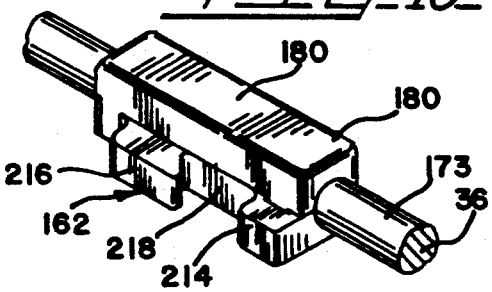
Figure 11:
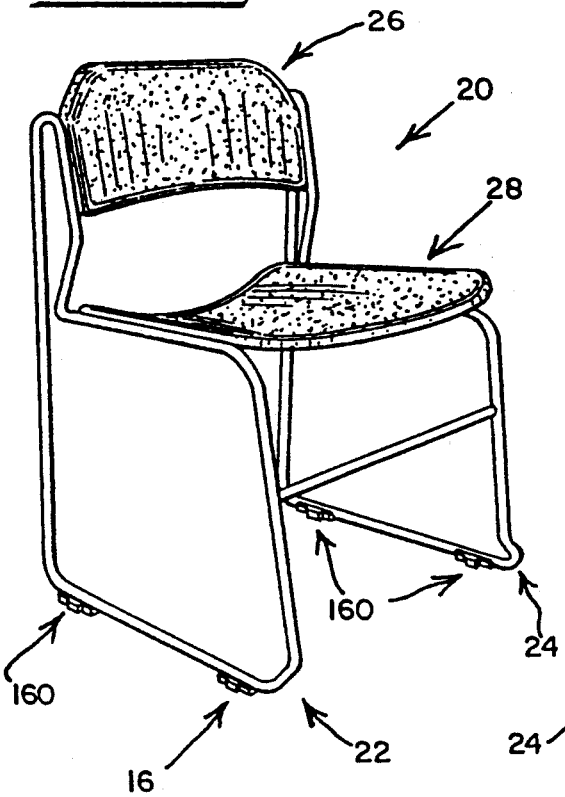
Figure 12:
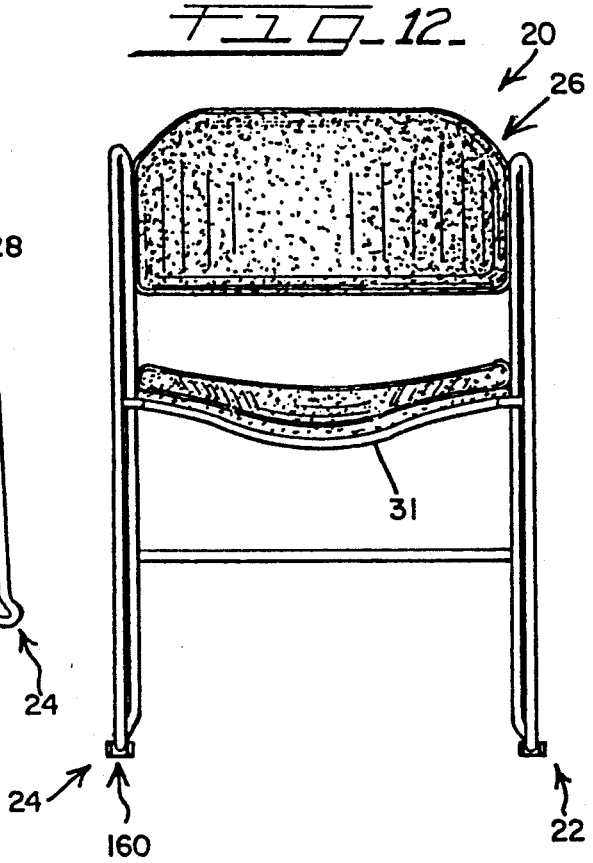
Figure 13:
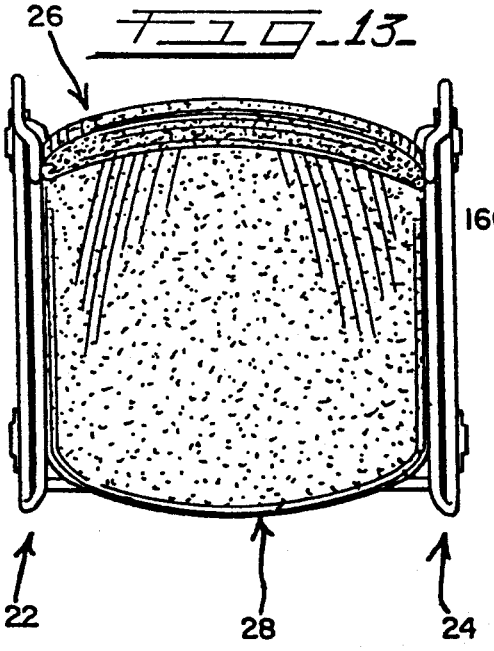

FIG. 3 is a left rear fragmental exploded perspective view showing the chair back pan that is fixed to and between chair shoulders defined by the wire rod type frames that form the sides of the chair, with the chair inner back shown displaced forwardly of the back pan, and indicating for both the back pan and the inner back that is illustrated the formation of each and the application of the inner back toward the back pan, that initiates the Applicant's fastenerless assembly of same together, in accordance with the present invention;

FIG. 3A is a fragmental perspective view on a greatly enlarged scale illustrating one of the inner back special integral latch tabs being presented through a special aperture for same, that is formed in the back pan, on initial application of the inner back to the pan;

FIG. 3B is similar to FIG. 3A except that it shows the inner back physically shifted relative to the back pan to bring its illustrated latch tab into latching relation with the back pan itself;

FIG. 4 is similar to the showing of FIG. 3, but shows the outer back or rear of the chair back displaced rearwardly of the chair from the back pan, with the chair inner back shown anchored to the back pan, and the back pan apertures that the outer back integral latch tabs are to be aligned with, by broken lines, for applying the outer back to the back pan in a manner similar to that shown in FIGS. 3A and 3B, except that the back pan apertures and the outer back tabs are oriented such that later latching movement of the outer back relative to the back pan is to be reversed to obtain the fastenerless securement to the seat back to the back pan that is contemplated by the present invention;

FIG. 5 is a vertical sectional view through the chair back assembly, taken substantially along line 5—5 of FIG. 2, indicating the relation of the chair inner back and the chair outer back to the back pan and showing a self tapping type screw connection between the inner and outer backs along their lower margins below the back pan to anchor them together and thus fix them to the back pan;

FIG. 6 is a left front perspective view of the chair of FIGS. 1 and 2, with the chair seat pan involved exploded away from the chair bracket plates therefor, indicating the same type of securement of the chair seat pan to the chair by way of its frame bracket plates;

FIG. 6A is a fragemental perspective view of the left side of the chair seat pan and major portion of the bracket plate that is to support same, with parts broken away, and showing the integral latch tabs of the seat pan in fastenerless securement relation with the illustrated bracket plate, that is provided on both the right and left sides of the chair set assembly, in accordance with the invention;

FIG. 6B is a fragmental sectional view, substantially along line 6B—6B of FIG. 6A, illustrating more specifically the ramp of the seat pan and the lancing of the bracket plate that are present on both the right and left sides of the seat assembly, to effect final fixing of the seat pan to the chair when the seat pan, after entry of its integral tabs into the respective apertures of the respective bracket plates, is pushed toward the rear of the chair to bring the seat pan ramps on either side of the chair over the lances of the respective bracket plates to lock the seat pan in place;

FIG. 7A is a fragmental perspective view of one of the chair lower, floor supported, runners, showing also a glide in accordance with the present invention that is snap fit applied to the runner, indicating also an optional glide cap may be applied to the glide, if so desired;

FIG. 7B is similar to the showing of FIG. 7A, except that it shows the glide as snap fit applied to the indicated chair runner, as well as a metal cover adapted to be applied to same for use where the chair is to engage surfaces such as bare concrete floors, under which circumstances the glide shown in FIG. 7A is applied to the runner 180 degrees from the position shown;

FIG. 7C is a transverse cross-sectional view through the glide of FIGS. 7A and 7B, taken substantially along line 7C—7C of FIG. 7A, better illustrating the internally formed ledges of same by which the glides of FIGS. 7A and 7B may be snap fit connected to the chair runner, and the metal cover of FIG. 7B may be snap fit connected to the glide;

FIG. 8A is a view similar to that of FIG. 7A, showing a ganging glide applied to the chair runner in accordance with the present invention;

FIG. 8B is a perspective view of several ganging glides ganged together, in accordance with the present invention, to releasably connect a number of the chairs (of FIGS. 1–8 and 11–14) side-by-side, in a row, and equally spaced apart;

FIG. 8C is a transverse cross-sectional view through the ganging glide of FIG. 8A, taken substantially along line 8C—8C of FIG. 8, with the runner omitted, and showing how one end of the ganging glide is equipped for snap fitting of the glide cap of FIG. 7A thereto (see FIG. 9);

FIG. 9 is a view similar to FIG. 8A, but showing a glide cap displaced from the ganging glide of FIG. 9 for application thereto;

FIG. 10 is a view similar to that of FIG. 9, but showing the glide cap applied to the ganging glide of FIG. 9;

FIG. 11 is a view similar to that of FIG. 1, but showing the chair back and seat upholstered (fabric covered), in accordance with the present invention;

FIG. 12 is a rear elevational view of the chair shown in FIG. 11;

FIG. 13 is a top plan view of the chair shown in FIG. 11; and

Figure 14:
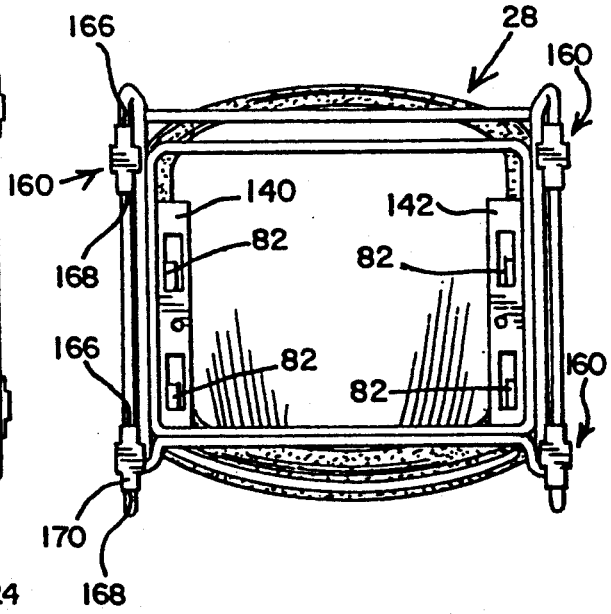

FIG. 14 is a bottom plan view of the chair shown in FIG. 11.

However, it is to be distinctly understood that the specific drawing illustrations referred to are provided primarily to comply with the requirements of the Patent Laws, and that the invention is susceptible of numerous other embodiments or modifications that will be readily apparent to those skilled in the art, and that are intended to be covered by the appended claims.

THE STACKING CHAIR AS A WHOLE

Reference numeral 20 of FIGS. 1 and 2 indicates the chair of the present invention, which comprises a right side frame member 22 and a left side frame member 24, which are joined together in substantial congruent, but spaced apart relation, by back assembly 26, seat assembly 28, a single front rod type reinforcing member 30, and a pair of rod type reinforcing members 29 and 31 (see FIG. 6) between which the seat assembly 28 is mounted.

THE CHAIR SIDE FRAME MEMBERS

The side frame members 22 and 24 of chair 20 comprise a pair of endless rodding members 32 and 33. The right rodding member 32 comprises a lower quadrilaterally contoured base portion 34 defining a lower supporting runner 36 that at the front of the chair merges into riser segment 38 that in turn merges into upper runner 40.

At the rear of the chair, the lower runner 36 merges into riser segment 42. The runner 40 and the riser 42 merge into vertically disposed, upwardly oriented loop portion 44 of the right rodding member 32 that defines chair shoulder 46.

The left rodding member 33 comprises a lower quadrilaterally contoured base portion 35 defining a lower supporting runner 37 that at the front of the chair merges into riser segment 39 that in turn merges into upper runner 41. At the rear of the chair, the lower runner 37 merges into riser segment 43. Both the riser segment 43 and the runner 41 at the rear of the chair merge into loop portion 45 that defines shoulder 47 at the left side of the chair.

Generally speaking, the chair back assembly 26 is anchored to the chair 20 by being applied between the chair shoulders 46 and 47, while the seat assembly 28 is anchored to the chair 20 by being secured to its upper runners 40 and 41. The reinforcement rods 29, 30 and 31, which may each comprise a length of the rodding similar to that making up rodding members 34 and 35, are affixed to the chair, by employing suitable welding techniques or the like to assemble together a pair of side frames 22 and 24 before the application thereto of the back assembly 26 and the seat assembly 28.

THE BACK ASSEMBLY AND MANNER OF SECUREMENT OF SAME TO CHAIR

Referring now to FIGS. 3–5, the back assembly 26 comprises inner back member 50, outer back member 52, and back pan 54 (see FIGS. 3 and 4). The inner back member 50 and the outer back member 52 are known in the art as the chair "inner back" and "outer back", respectively, and these terms henceforth will be used in this description in connection with reference to the components shown by reference numerals 50 and 52.

In accordance with the present invention, the chair inner back 50 and the chair outer back 52 are secured to the chair back pan 54, assuming that the pan 54 has been first fixed to the respective forward segments 44A and 45A, of the respective loops 44 and 45 (see FIG. 3), as by practicing welding techniques at the opposite ends 54A and 54B of the pan 54, or some other equivalent bonding procedure). The general shaping of the back pan 54 may be of any configuration employed in the art, with the pan 54 being usually formed from a metal such as a suitable grade of steel. The inner back 50 and the outer back 52 have a general configuration suitably conforming to that of pan 54, considering also (in accordance with the present invention) that the pan 54 when the back assembly 26 is completed, is fully enclosed within the chair inner and outer backs 50 and 52, as is clear from the showing of FIG. 5.

The back pan 54, in the form shown includes in addition to ends 54A and 54B, top edging 55, front surface 57, rear surface 59 and bottom or lower edging 61.

Further in accordance with the present invention, the chair inner back 50 and the chair outer back 52 are both formed from a suitable plastic material, such as polycarbonate, polypropylene, or polyester type materials, for instance. In any event the material selected for the inner back 50 and the outer back 52 should be opaque, and, of course, moldable in accordance with the present invention.

As indicated in FIGS. 3, 3A and 3B, the inner back generally comprises forwardly facing outer surface 60 (see FIG. 1), rearwardly facing inner surface 62, and upper or top edging 64 in the form of rearwardly projecting top flange 65, upright side edges 66 and 68 that are proportioned to be readily disposed adjacent the respective side edges 54A and 54B of the pan 54, and a bottom edge 70 that smoothly merges into the respective side edges 66 and 68 and underlies and is spaced from a similarly shaped bottom flange 72 that projects rearwardly of the chair (see FIG. 5).

The chair inner back 50 on its surface 62 is also formed to define, in accordance with the illustrated embodiment, three tabs 74, 76, and 78 that are of "L" configuration, and integral with the inner back 50. The tabs 74, 76, and 78 each define a base portion 80 that extends normally of the surface 62 of the inner back and rearwardly of the chair, which merges into a rearwardly disposed latch portion 82 that is also disposed normally of latch portion 82. The base portion 80 of these tabs may be suitably reinforced, as indicated in FIGS. 3A and 3B.

As indicated in FIG. 3, the seat pan 54 is formed with keyhole like, L shaped apertures 84, 86, and 88, each having an wide upper portion 90 and a narrow lower portion 92 to form a fastenerless connection of the seat inner back 50 with the seat back pan 54. As indicated by the broken lines of FIG. 3, the respective tabs 74, 76, and 78 are to be moved into the larger portions 90 of the respective seat pan apertures 84, 86, and 88, with the seat back 50 being moved bodily toward the seat back pan for this purpose; when the three tabs 74, 76 and 78 are located with respect to the respective apertures 84, 86 and 88 in the manner indicated in FIG. 3A, that is, when the latch portions 82 of the tabs 74, 76, and 78 are disposed behind the back pan 54, on movement of the inner back 50 downwardly that brings the respective tabs 74, 76 and 78 within the narrow portions 92 of the respective apertures 84, 86 and 88, the latching portions 82 of the respective tabs 74, 76 and 78 will be in locking relation to the back pan 54 in the manner indicated in FIG. 3B (that is, behind the seat back pan and in overlying relation to its surface 59).

As indicated in FIG. 3, apertures 84 and 88 are at opposite ends of the back plate 54, and the tabs 74 and 78 that are to enter same (as indicated by FIGS. 3A and 3B) are oppositely oriented, but this orientation is a matter of choice and design, since it is the locking arrangement shown in FIG. 3B that the Applicant is concerned with to provide a fastenerless attachment of the inner back 50 to the seat pan 54.

The inner back 50 is shown in FIG. 4 secured to the seat back pan 54 by way of the respective tabs 74, 76 and 78 presented as indicated with regard to the respective seat pan apertures 84, 86 and 88.

The seat outer back 52 is affixed to the seat back pan 54 in the same manner.

The outer back 52 is of the same general shaping as the inner back 50, though, as indicated in FIG. 5, the illustrated embodiment of the back assembly 26 is concerned with the outer back 52 being proportioned to fit in close adjacency the inner back 50, and above and below the back pan 54, in the manner indicated in FIG. 5, with the outer back 52 defining outer surface 94, that faces rearwardly of the chair, inner surface 96 that is to face the seat pan 54, the arcuate top edge 98 that is integral with forwardly projecting arcuate top flange 100, the side edges 102 and 104 that are proportioned to be disclosed closely adjacent the respective side edges 54A and 54B of the pan 54, and bottom edging 106 with which forwardly projecting flange 108 is integral, with the top flange 100 of the outer back 52 being proportioned to fit over the top edge 55 of the pan 54, and the flange 108 of the member 52 being proportioned to underlie the flange 72 of the inner back 50 when these parts are assembled.

The outer back 52 is formed of the same type of material as inner back 50, it also being opaque, and it also is formed to define at its surface 96 the respective tabs 110, 112, and 114 that have the same base and latch portions 80 and 82 that tabs 74, 76 and 78 have, and are positioned and oriented to enter the respective back pan apertures 116, 118 and 120. Thus, the respective back pan apertures 116, 118 and 120 each have the large portions 90 and the narrow portions 92 of the respective apertures 84, 86 and 88, with the objective being that the outer back 52 is to be brought toward the back pan 54 from rearwardly of the chair to lodge its tabs 110, 112 and 114 in the respective larger portions 90 of the respective back pan apertures 116, 118, and 120, and after the respective tabs of the outer back 52 are positioned as indicated in FIG. 3A, the outer back 52 is raised to lodge the latching portions 82 of the respective tabs 110, 112 and 114 in latching relation to the back pan 54 and in overlying relation to the seat pan surface 57. The parts of the back assembly 26 are proportioned so that the overlying relation of the latching portions 82 of the respective tabs 110, 112, and 114 with the corresponding surfacing of the seat pan 54 will hold these parts sufficiently close together pending application of one or more self tapping screws 122 (see FIG. 4) to the flanges 106 and 72 of the respective backs 50 and 52, as indicated in FIG. 5 that fix backs 50 and 52 together, and thus they cannot be displaced from pan 54. In the illustrated embodiment a pair of such screws 122 and 124 are employed for this fixturing purpose.

As was the case with the inner back tabs 74, 76, and 78, and apertures 84, 86, and 88, the orientation selected for the corresponding tabs 110, 112, and 114 of the outer back 52 relative to the back pan apertures 116, 118, and 120, may be arranged to have these corresponding components oppositely delineated, as, for instance, compare tab 110 and its aperture 116 with the tab 114 and its aperture 120. However, if desired, the locking tabs and locking apertures for any one inner back 50 or outer back 52 may be oriented all in the same manner, if so desired.

As indicated in FIG. 5, the arrangement is such that when the inner and outer backs 50 and 52 have been disposed relative to the pan 54 such that their respective sets of locking tabs are in locking interfitting relation with the pan 54, the inner and outer backs 50 and 52 in their attachment relation to the pan 54 may be adjusted vertically with respect to each other, so as to define a variable gap therebetween adjacent the respective flanges 65, 72, and 100. It is a feature of the present invention that should it be desired to upholster or fabric cover the seat back assembly 26, the surface 60 of the inner back 50 may be covered with a suitable fabric that has its edgings appropriately stapled or otherwise fastened, to the surface 62 of the inner back, so as to be turned over the respective flanges 65 and 72 and be spaced from the respective tabs 74, 76, and 78 so as to not interfere in connection with the cooperation of same with the back pan respective apertures 84, 86, and 88 and its back surface 59 upholstered or fabric covered.

Similarly, should it be desirable that the outer back 52 be upholstered or fabric covered, the outer back exterior surface 94 is covered with a suitable fabric, which has its ends turned over the edgings of the outer back 52 (including flange 100) and glued or otherwise fastened to its surface 96 in a similar manner.

Assuming that either one of the backs 50 or 52 is to be fabric covered, as indicated, or that both of them are, the gap between the inner and outer backs 50 and 52, for instance, the gaps at the respective flanges 65 and 72 of the inner back 50, will vary with the fabric thickness; after adjustment is made of the two backs 50 and 52, by shifting them as needed relative to the plane of pan 54 to roughly even such gaps, as desired by the installer, the self tapping screws 122 and 124 are applied thereto to hold the inner and outer backs in adjusted fixtured relation. The self tapping screws 122 and 124 (or other similar fastening devices employed) are shown to be two in number, but the number employed is a matter of choice although it is preferred to use at least one such screw 122 to fix the inner and outer backs 50 and 52 in adjusted or fixtured relation to avoid either back having enough movement relative to back pan 54 to permit dislodgement from the chair 20.

THE SEAT ASSEMBLY AND MANNER OF SECUREMENT OF SAME TO CHAIR

Referring now to the diagrammatic showing of FIG. 6, the seat assembly 28 is there shown in exploded relation.

In accordance with the present invention, the seat assembly 28 is applied between the supplemental reinforcing rods 29 and 31 (that are welded between the respective chair side frame members 22 and 24, and preferably have the downwardly curved configuration conforming to the curvature built into conventional chair seats, such as that indicated).

The seat assembly 28 comprises a seat pan 130 that may be formed from the same plastic material as the inner and outer backs 50 and 52, but which is in the form of a single plate like member having the usual configuration suitable for a chair seat, including top side surfacing 132, underside or bottom surfacing 134 (see FIG. 6B) front edge 129, side edges 133 and 135 and back or rear edge 137. As indicated, seat pan 130 is made in a configuration suitable for seats of chairs of the type involved, for the usual user physical comfort purposes, and the top side surface 132 especially should conform to this type of surfacing configuration.

The chair seat assembly 28 further comprises a pair of elongate metallic (preferably a suitable grade of steel bracket plates 140 and 142 suitably affixed to the chair in opposition to each other, and in substantially parallel aligned relation, by having the outwardly disposed edges of same suitably adhered to the respective runners 40 and 41, by practicing welding techniques or the like.

As was the case with the chair inner and outer backs 50 and 52, the securement of the seat pan 130 to the respective brackets 140 and 142 is by way of providing therefor a similar latching tab-aperture arrangement, in which the seat pan 130 adjacent its respective side edges 133 and 135, and on the underside of same, is provided with the indicated pairs of latching tabs 136 and 138 (see FIG. 6) that have the same latching engagement with the respective bracket plates 140 and 142 that has been disclosed with regard to the inner and outer backs 50 and 52. Thus, bracket plate 140 is formed with a pair of apertures 144 spaced apart to receive the respective tabs 136 of seat pan 130, while bracket plate 142 is formed with a pair of apertures 146 that are spaced apart to receive the respective latching tabs 138. The tabs 136 and 138, respectively, and the respective apertures 144 and 146, are located and oriented in the same manner as the corresponding latching tabs and apertures therefor that have been disclosed with regard to the inner and outer backs 50 and 52, and back pan 54 (see FIGS. 3 and 4); in this connection, it will be noted that the respective tabs 136 and 138 each have the aforedescribed base portion 80 and latch portion 82, though the latching portions 82 of the respective tabs 136 and 138 are oppositely oriented, as are the corresponding wide and narrow portions of the respective apertures 144 and 146, each of the latter including the respective aperture wide portions 90 and the respective aperture narrow portions 92 (see FIG. 6A).

It will thus be seen that the seat pan 130, when oriented in the manner indicated in FIG. 6 above the chair 20 that is to receive same, with the respective sets of latching tabs 136 and 138 positioned to be received in the respective wide portions 90 of the respective apertures 144 and 146, may be applied to the fixedly mounted bracket plates 140 and 142 by lowering the seat pan 130 to bring the respective sets of latching tabs 136 and 138 through the respective wide portions 90 of the respective apertures 144 and 146, and then shifting the seat pan 130 rearwardly of the chair to the latching position of FIG. 6A.

As has been shown in FIG. 6B, the seat pan 130 between the respective sets of latching tabs 136 and 138 is formed with a ramp 150 defining a depending stop surface 152 that during this movement of the seat pan 130 with respect to the respective bracket plates 140 and 142 rides over a similar ramp 154 defined by the respective bracket plates, as by appropriately lancing same at some point in their manufacture, or utilizing some other similar stop forming method. With the seat pan 130 positioned with regard to the bracket plates in the manner indicated in FIGS. 6A and 6B, the seat pan is locked against forward movement relative to the chair, and, of course, is locked in place in the chair, with the tab latch portions 82 disposed behind the respective bracket plates 140 and 142.

In the chair embodiment shown in FIGS. 1–6B, the seat pan 130 is not upholstered, but it may be upholstered if so desired prior to application to the chair, by suitably covering the surface 132 of same with a suitable fabric, and bringing the fabric over the seat pan front, rear, and side edges, in the manner indicated in FIG. 14, for trimming same and fixing same to the seat pan 130, in any suitable manner (as by employing cutting and stapling), with the resulting edges of the fabric being located short of the respective latching tabs 136 and 138 on either side of the seat pan.

The thus fabric covered seat pad 130 may then be applied to the chair bracket plates 140 and 142 in the same manner as described.

The chair 20 having its back assembly 26 and its seat assembly 28 fabric covered is shown in FIGS. 11–14. It is also within the scope of the invention to provide a padding layer between the fabric and the plate member being unholstered, at least insofar as the inner back 50 and the seat pan 130 are concerned; the foam may be of any suitable type that normally would be relatively thin in transverse cross-sectional dimension in view of the hereindisclosed nature of the seat back and seat assemblies 26 and 28, respectively. The invention also contemplates that the chair 20 may be provided with the back assembly 26 not upholstered and the seat assembly 28 upholstered, and vice versa, as will be clear to those skilled in the art.

THE CHAIR GLIDES

As indicated in FIGS. 1, 2, and 11–14, the chair 20 and its runners 36 and 37 is provided with multipurpose glides 160 that are shown in FIGS. 1, 2, and 11–14, to separate the chair from the carpeting, where carpeting forms a floor covering involved, or to separate the chair from concrete or other floor surfacing where no carpeting is employed where the chair is to be used. The glide 160 is for single chair use and thus may termed a "standard" glide, while an alternate form of glide 162 may be employed (see FIGS. 8A–10); glide 162 is of the ganging type in which a number of chairs 20 are to be connected in side-by-side relation in a single row of several or more chairs. Such glides 160 and 162 are preferably formed from a suitable transparent plastic material, such as a polycarbonate base plastic.

Both forms of glides are illustrated in FIGS. 7A through 10 in which the glides and associated parts are shown enlarged for better understanding of the nature of the glides involved.

In the showing of FIGS. 7A, 7B and 7C, the so-called standard glide 160 is illustrated, while in the showings of FIGS. 8A through FIG. 10, the ganging glide 162 and associated parts are illustrated.

With regard to the standard glides 160, each such glide comprises an elongate body 164 defining planar ends 166 and 168, plain sides 167 and 169, a flat or planar underside 170 (see FIG. 14), and top side 171, with a centrally located longitudinally extending arcuate groove 172 being defined by the glides 160 and proportioned to complement the external surfacing 173 of the respective chair runners 36 and 37 (which are of the same external diameter). The respective glide bodies 164 also are formed to define opposed ledges 174 that are to project into the respective grooves 172, and are proportioned to snap fit into the respective runner grooves 172 that are formed 180 degrees apart on either side of the respective runners 36 and 37 for snap fit application of the respective glides 160 to the respective runners 36 and 37, for insuring that the glide flat underside surface 170 rests flush against the carpeting that the chair 20 is to rest on.

As indicated in FIG. 7A, the body 164 adjacent its respective ends 166 and 168 is formed to define identical notches 186 on either side of same for snap fit application to glide 160 of a suitable glide end cap 180 that is formed from the same material as the respective bodies 164 and defines the respective pairs of opposed end legs 182 bearing opposed end lugs 184 that are to snap fit into the glide respective into notches 186 that are formed at either end of the body 164. Use of the glide cap 180 is not necessary, and it thus an optional component of the invention, and when applied to a glide 160 presents the appearance that is shown in FIG. 10 (with regard to the ganging type glide 162).

For optional use where the floor that the chair is to rest on is uncovered and is of concrete, the standard glide 160, namely the body 164 defining same, is formed to define on either side of the groove 172 a pair of parallel centrally located through passages 190 that bear within same ledges 194 (see FIG. 7C) that are in opposed relation for snap fit application to the respective glides 160 a cover 196 formed from metal or the like.

The cover 196 comprises elongate body 198 (see FIG. 3B) in the form of strip 200 that is formed to define at its mid portion a pair of centrally located tabs 202 appropriately formed to define lugs 204 that are to be snap fitted behind lugs 194 when the metal cover 196 is applied to a glide 160 that is, to the respective passages 190. The body 198 is also formed with right angled end flanges 206 and 208.

The cover 196 is applied to a standard glide body 164 by applying the glide 160 to the chair runner, for instance, the chair runner 36, in a position of 180 degrees from the position of FIG. 7B, disposing the cover 196 in alignment with the glide 160 that has been applied to the runner in question in the indicated 180 degree inverted position, inserting the metal cover tabs 202 into the glide passages 190 from the side 171 of same and pressing the tab toward the glide to snap fit its shoulders 204 past the shoulders 194 thereof. The end flanges 206 and 208 are positioned to be closely adjacent the respective ends 166 and 168 of the glide 160 as the cover 196 is applied to the respective glides 160.

Referring now to the ganging glides 162, the ganging glide is basically similar to the standard glide 160, including the sides 170, 171, the ledges 174, and the passages 190 and the ledges 194 contained therein, that have been previously described, but the body 210 of same is formed to define a plain side 212, similar to the corresponding sides 167 and 169 of the glide 160, and a lugged side 214 that is formed also to define side lug 216 and lug receiving notch 218. The lugs 216 and notches 218 define the same configuration, such that lugs 216 freely but loosely fit into notches 218, and notches 218 freely receive lugs 216, when such glides 162 are disposed side-by-side, as in FIG. 8B, so as to dispose their sides 214 facing each other.

The ganging glide 162 is to be applied to the chair runners in the same manner as glide 160, with FIG. 8A showing the glide 162 secured to the runner 36 of a chair 20 with its side 214 directed outwardly of the chair and the side 212 directed inwardly of the chair and opposing the corresponding side 212 of the glide 162 that is applied at the forward position on runner 37. The glides 162 applied to the rearward positions on the respective runners 36 and 37 are to be similarly oriented.

When so oriented, the chair runner supported glides 162 at their respective lugged sides 214 are positioned to loosely receive the lug 216 of a similar glide 162 placed on the left hand side of a chair 20 that is connected to the right hand side of the chair 20, for instance the chair 20 shown in FIG. 1, and vice versa; again assuming that the second chair 20 that is to be on the right side of the chair 20 of FIG. 1 has the glides 162 on the runner 37 of same that have been described, the glides 162 of the two now adjacent runners 37 and 36 of the adjacent chairs 20 may be interconnected at their respective sides 214 in the manner indicated in FIG. 8B, both at the forward and rearward glide positions. Similarly, other chairs 20 equipped in the same manner with ganging glides 162 may be connected together in a similar manner side-by-side for securing such chairs 20 in a single row of same in which the chairs are in side-by-side relation.

Referring to FIG. 9, the body 210 of the ganging glides 162 is formed at its end 230 with identical notches 232 on its respective sides 212 and 214 for snap fit application to that end of slide 162 of glide end cap 180 (see FIG. 7A). The other end 234 is formed with a notch 232 on its side 212, while on its side 214 the glide 162 is formed with cross passage 236. The notches 232 each define a shoulder 238, which the cross passage 236 defines a similar shoulder 240 (see FIG. 8C). Thus, applying the end cap 180 to a glide 12 in the manner indicated in FIG. 9, the cap lugs 184 are snap fitted behind the respective shoulders 232, to provide the positioning of cap 180 relative to its glide 162 that is shown in FIG. 10. Again, the use of glide cap 180 is not necessary, and it is thus an optional component of the invention.

It will therefore be apparent that the ganging glides 162 of adjacent of such chairs 20 in a single row of such chairs interlock in a "jigsaw puzzle" type configuration to securely lock them together in side-by-side relation, and yet because of the loose interfitting nature of the respective lugs 16 and notches 18, adjacent chairs readily disengage at their respective interconnected glides by merely lifting the chairs upwardly, when so desired, as for stacking purposes.

It will therefore be seen that the invention provides an office furniture chair arrangement in the nature of a side chair that not only is inexpensive of manufacture, but is easily assembled by relatively unskilled persons due to the nature of the chair and the simplified and expeditious manner of assembling the back and seat assemblies of the chair involved.

Furthermore, the arrangement of the seat back and seat assemblies is such that they may be utilized with and without upholstery, and where upholstery is desired, it can be applied to either or with the backs of the seat back assembly, or to the seat assembly, at the assembler's or purchaser's option, with the chair back and seat assemblies being assemblable without requiring sophisticated tooling, and with the chair back assembly and seat assembly, where upholstery is desired for either assembly, being arranged to ease the application of fabric thereto and mask the fabric trim when assembly is completed, and basically regardless of the thickness of the fabric material employed.

The chair glides adapt the chair for use with floor surfaces most frequently encountered in practice, namely carpet covered floor surfaces and concrete surfaces themselves. The ganging modification of the glides permits securement of a number of the chairs in side-by-side relationships, so that a number of such chairs can be put in a short or long row along a room floor if so desired, with the chair glides readily disconnecting for chair stacking when needed.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

We claim:

1. In a chair that includes a back assembly in the form of a fixedly mounted back pan, an inner imperforate opaque back member, and an outer imperforate opaque back member, with said members being of a similar sizing and being disposed in encapsulating relation on either side of said back pan to define oppositely facing back surfaces, with said inner back member and said back pan respectively including first hooks and corresponding first keyholes for adjustable mounting said inner back member on the inner side of said back pan by limited movement of said inner back member in a first direction relative to said back pan, and said outer back member and said back pan respectively including second hooks and corresponding second keyholes for adjustably mounting said outer back member on the outer side of said back pan by limited movement of said outer back member in a second direction relative to said back pan, the method of attaching said members to said back pan including the steps of:

disposing said inner back member adjacent said back pan with said first hooks disposed through said corresponding first keyholes in said back pan;

shifting said inner back member in said first direction to bring said inner back member into adjustable anchored relation with said back pan;

disposing said outer back member adjacent said back pan with said second hooks disposed through said corresponding second keyholes in said back pan; and shifting said outer back member in said second direction to bring said outer back member into adjustable anchored relation with said back pan.

2. The method set forth in claim 1, wherein, after said back members are adjustably anchored to said back pan, said back members are anchored together with one or more self-tapping screws.

* * * * *